United States Patent [19]

Wainwright

[11] 3,934,533

[45] Jan. 27, 1976

[54] AEROFOIL OR HYDROFOIL

[76] Inventor: Barry Wainwright, 36 Southdown Road, Westbury-on-Trym, Bristol, England

[22] Filed: Sept. 12, 1973

[21] Appl. No.: 396,471

[52] U.S. Cl. ..... 114/103; 114/39; 114/66.5 H; 244/42 R

[51] Int. Cl.[2] ..... B63H 9/04

[58] Field of Search..... 114/66.5 R, 39, 102, 103; 244/40 R, 42 R, 42 CA, 42 CB, 42 CC, 42 CD, 42 CF, 42 CE, 42 D, 42 DA, 42 DB, 42 DC, 44

[56] References Cited

UNITED STATES PATENTS

| | | | |
|---|---|---|---|
| 2,319,999 | 5/1943 | Jennings | 114/39 |
| 3,275,265 | 9/1966 | Alvarez-Calderon | 244/42 CC |
| 3,371,888 | 3/1968 | Alvarez-Calderon | 244/42 DB |
| 3,638,886 | 2/1972 | Zimmer | 244/42 CA |

FOREIGN PATENTS OR APPLICATIONS

| | | | |
|---|---|---|---|
| 198,649 | 5/1924 | United Kingdom | 114/39 |
| 459,730 | 1/1937 | United Kingdom | 244/42 D |
| 570,482 | 5/1924 | France | 244/44 |

*Primary Examiner*—George E. A. Halvosa
*Assistant Examiner*—Jesus D. Sotelo
*Attorney, Agent, or Firm*—Cushman, Darby & Cushman

[57] ABSTRACT

A reversible aerofoil or hydrofoil has a central panel with lateral panels hinged thereto. The section of the central panel is symmetrical on either side of a central axis and the lateral panels are of similar section to each other. Either of the lateral panels can be folded in to lie against the central panel or the other lateral panel or both, while the other lateral panel is extended, the combined panels thereby forming a non-symmetrical aerofoil or hydrofoil section. By extending the folded-in lateral panel and folding in the extended one, the section is reversed.

9 Claims, 16 Drawing Figures

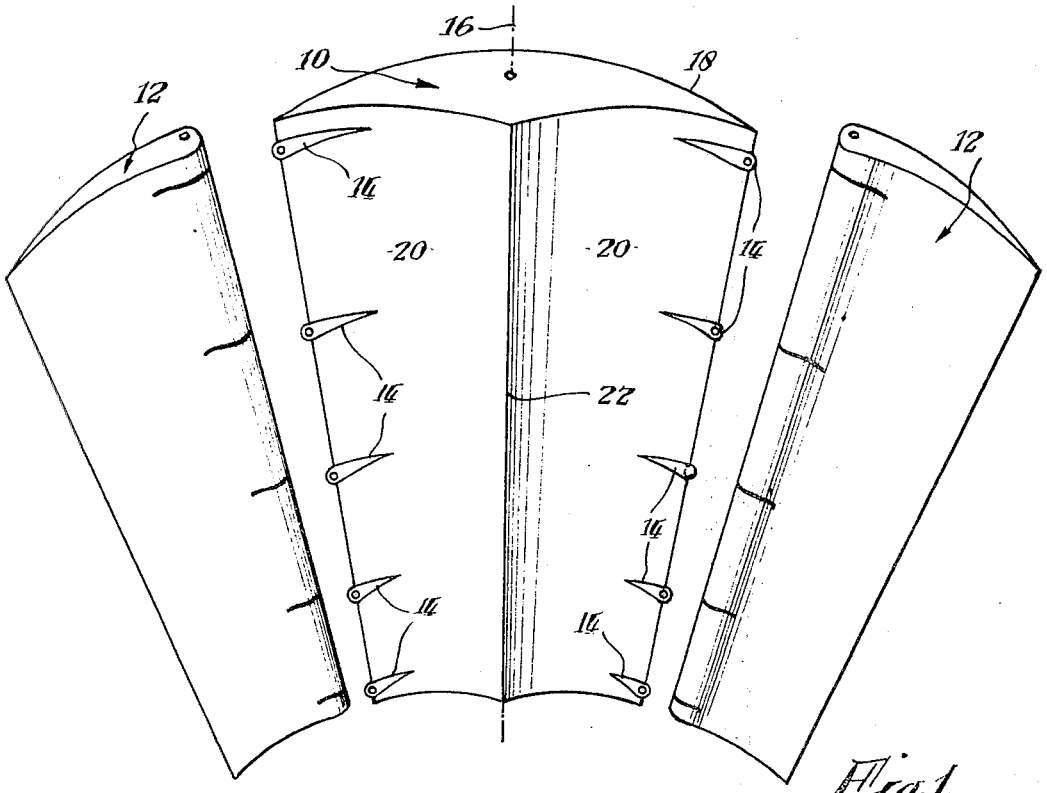
Fig. 1.
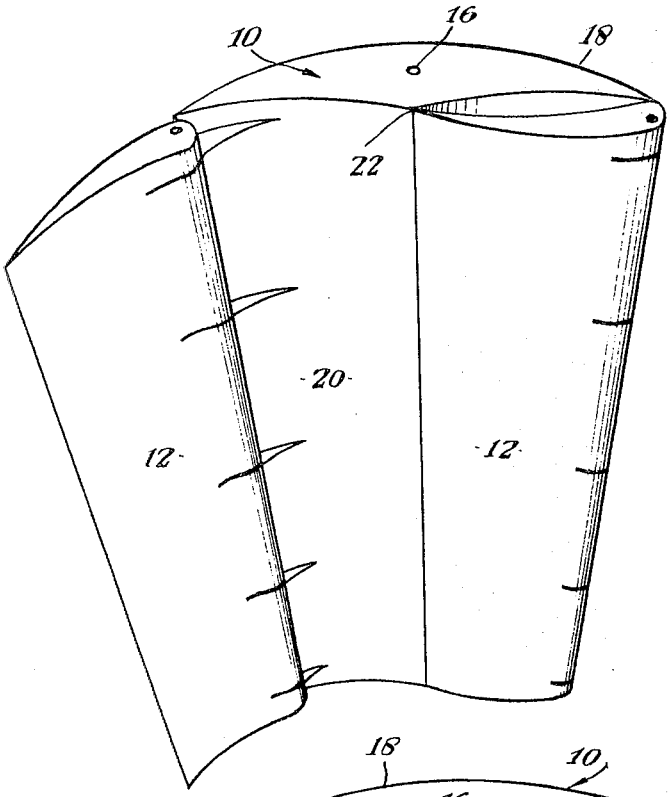
Fig. 2.
Fig. 3.
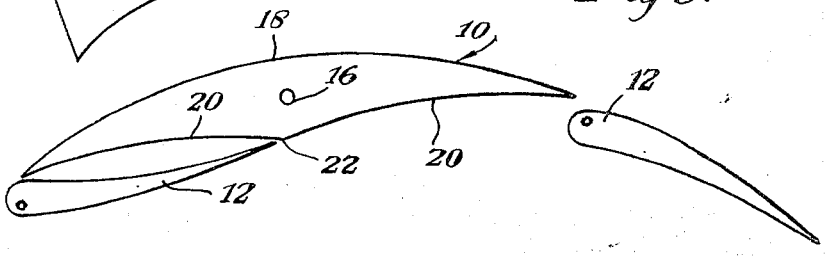

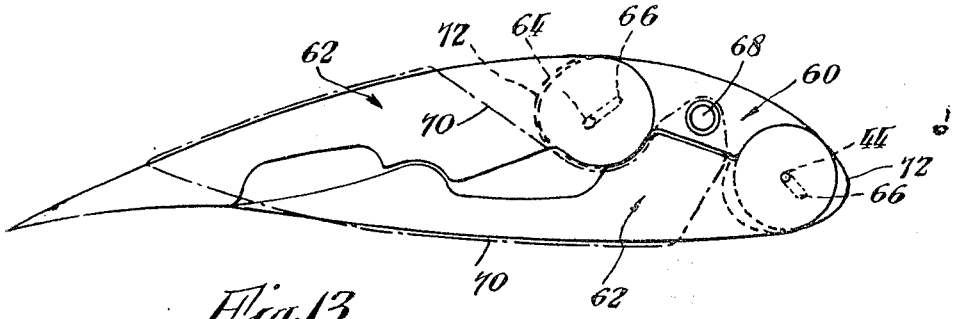
Fig. 13.
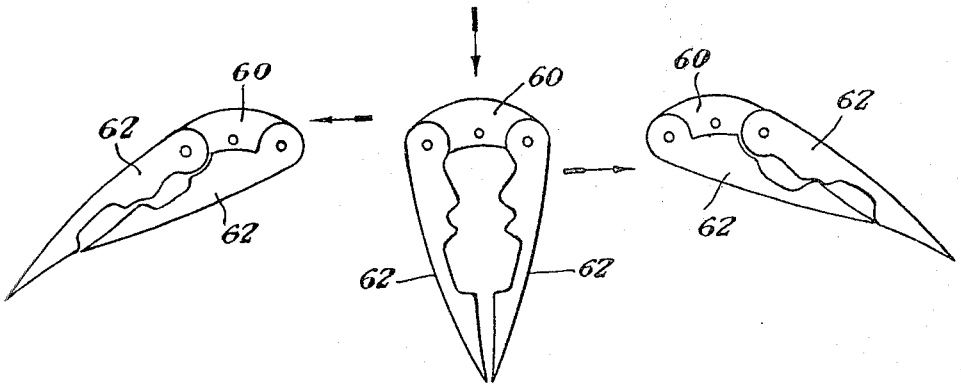
Fig. 14.
Fig. 15.
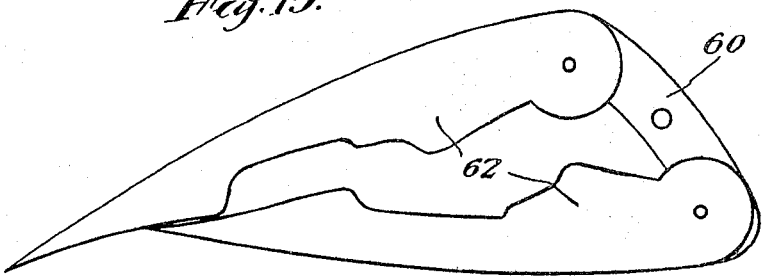
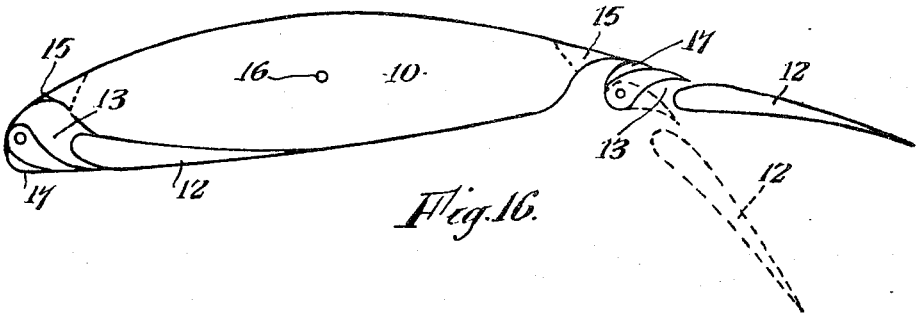
Fig. 16.

AEROFOIL OR HYDROFOIL

This invention relates to aerofoils and hydrofoils of non-symmetrical section. It is especially applicable to rigid aerofoil sails for use with sailing vehicles, which may be water or land craft. It has as an object to provide a reversible aerofoil or hydrofoil section.

The present invention provides an aerofoil or hydrofoil, comprising a central panel and lateral panels hingedly connected at each side thereof, the lateral panels on the two sides being of similar cross-section and the central panel of symmetrical cross-section on either side of a central axis, the cross-sections of the panels being such that the lateral panels on either side can be folded inwardly to lie against the central panel or the opposite lateral panel or both, the combined panels thereby forming a nonsymmetrical aerofoil or hydrofoil in cross-section, the mirror-image of which can be produced by alternatively folding in the lateral panels of the other side.

More than one lateral panel may be provided on each side, hinged one to the next, but preferably only a single lateral panel is provided on each side.

The lateral panels may be interconnected by tie means adapted so that they move in concert between the alternative positions. In this form, adjustment of the aerofoil or hydrofoil can be made merely by rotation of the central panel about its axis, the shape of the section being changed automatically, if appropriate, by the pressure of the relatively moving flow of air on the lateral panels.

The aerofoil may be supplied for mounting to an existing craft, or sailing craft may be purpose-built to incorporate the aerofoil. The invention therefore includes sailing craft incorporating such an aerofoil.

In order that the invention may be more clearly understood, various embodiments will now be described with reference to the accompanying drawings wherein:

FIG. 1 shows an exploded view of a first embodiment of aerofoil,

FIG. 2 shows a perspective view of the assembled aerofoil in one configuration,

FIG. 3 shows the aerofoil section in the opposite configuration,

Figure 4:
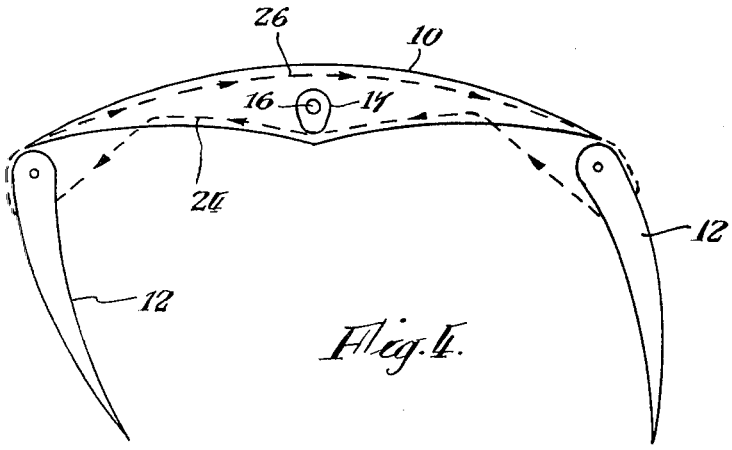
Figure 5:
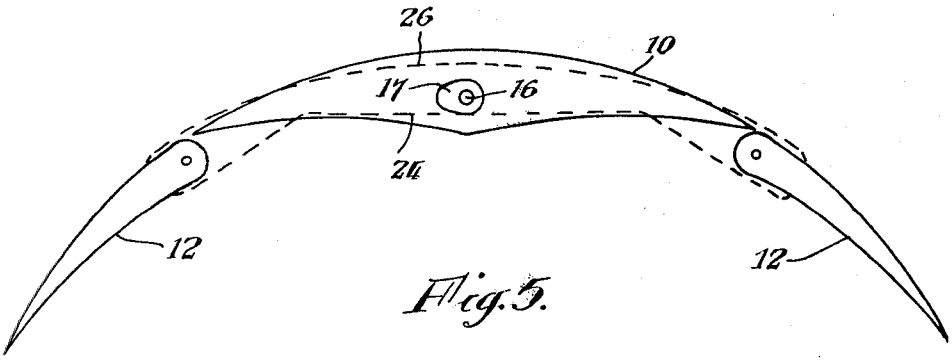
Figure 6:
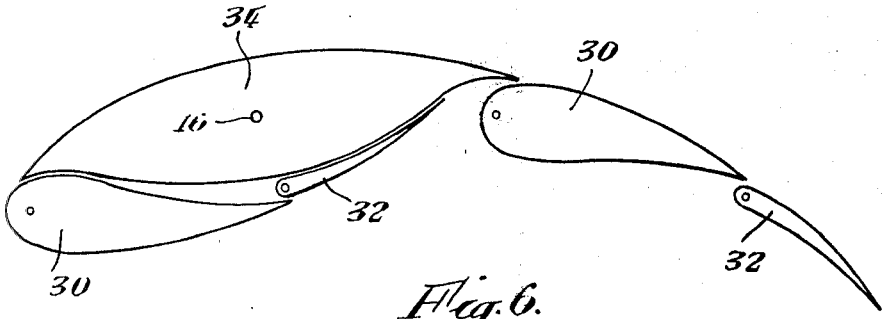
Figure 9:
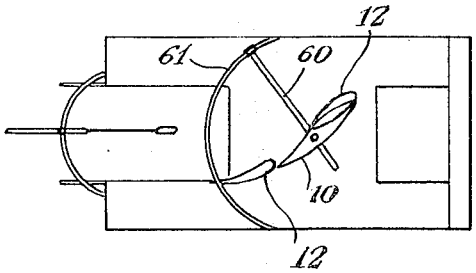
Figure 10:
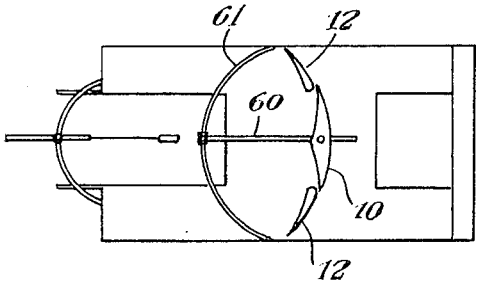
Figure 11:
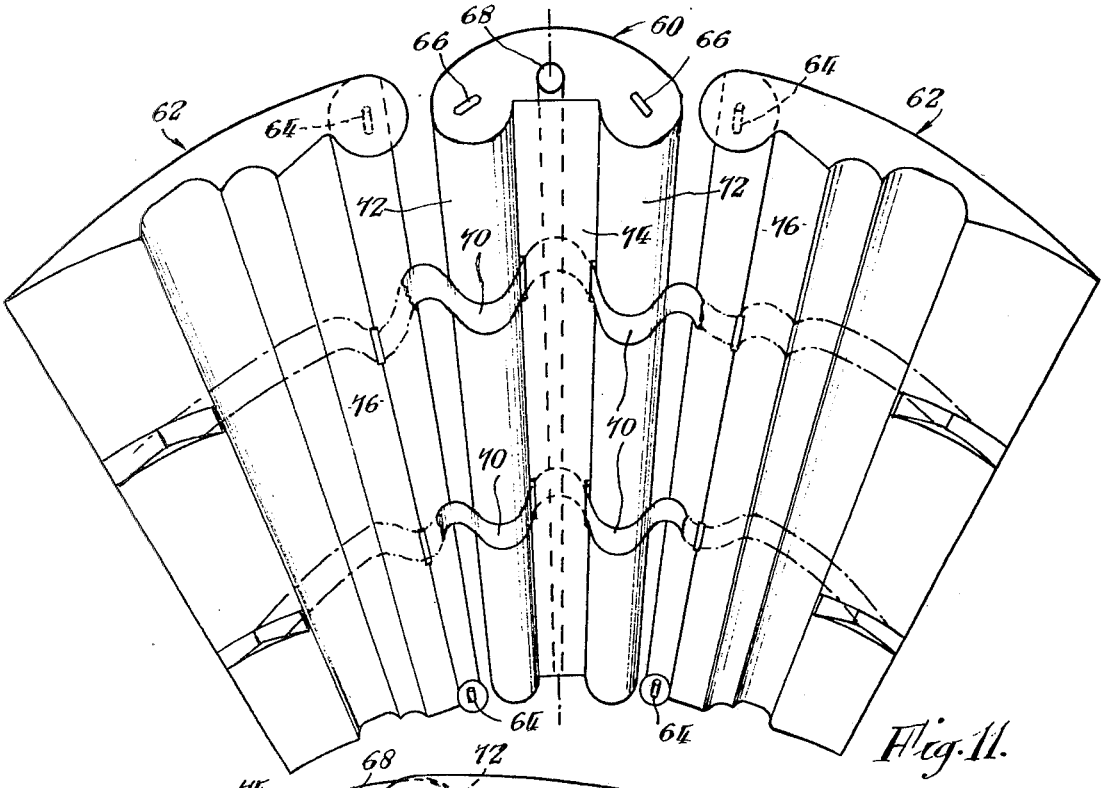
Figure 12:
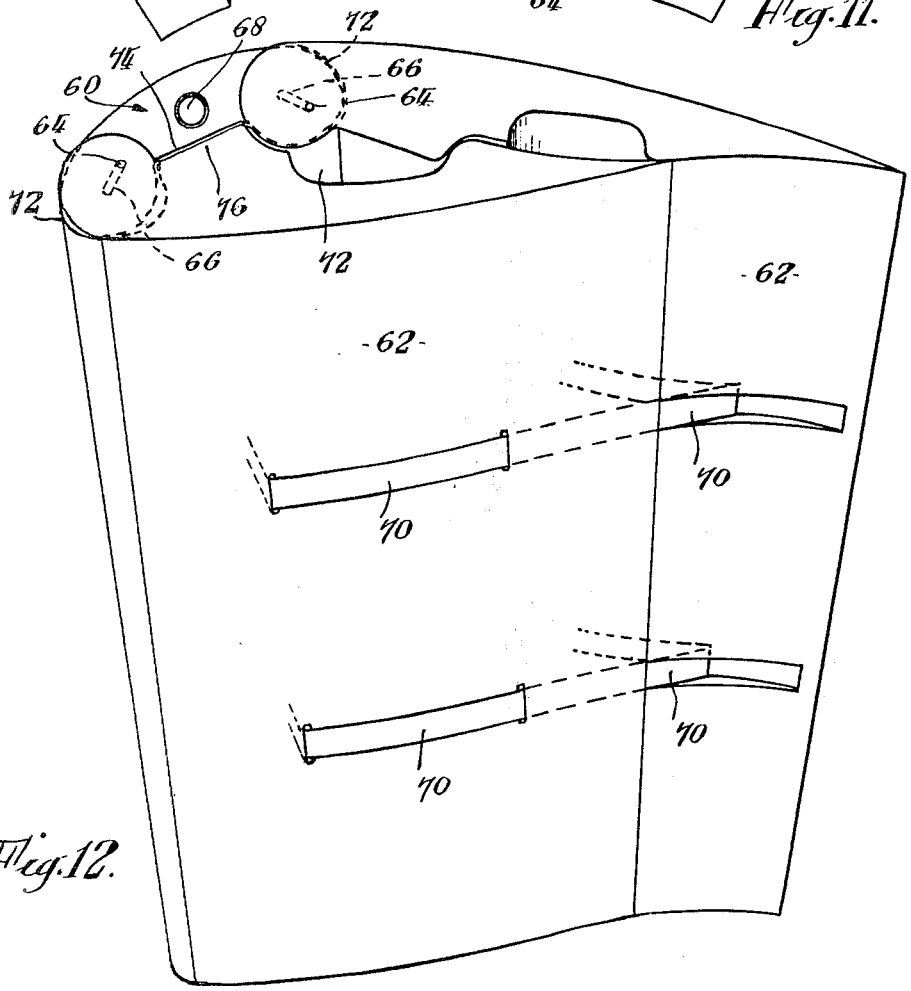

FIG. 4 shows the aerofoil section in an intermediate position of the lateral panels, and indicates diagrammatically the tie means which interconnect the lateral panels, FIG. 5 shows a special open configuration of the aerofoil, FIG. 6 shows one configuration of a modified form of the aerofoil of FIGS. 1 to 5, FIG. 7 shows a perspective view of a sailing craft incorporating the aerofoil of FIGS. 1 to 5, FIGS. 8 to 10 show diagrammatic plan views of the sailing craft with the aerofoil in various configurations, FIG. 11 shows in perspective an exploded view of another embodiment of aerofoil, FIG. 12 shows a perspective view of the assembled aerofoil in one configuration, FIG. 13 shows the aerofoil section in the opposite configuration, indicating diagrammatically the tie means which interconnects the lateral panels, FIG. 14 shows the manner in which the configuration of the aerofoil is altered by the direction of the prevailing wind, FIG. 15 shows a modified aerofoil configuration, and FIG. 16 shows a modification of the aerofoil of FIGS. 1 to 5.

Referring to the drawings, and firstly to FIGS. 1 to 4, the aerofoil sail consists of three rigid parts, a central panel 10 and two lateral panels 12 hinged through brackets 14 one to each side of the central panel 10. The two lateral panels 12 have similar aerofoil cross-sections, as can be seen from the drawings, and are hinged to the central panel at the leading edge of the aerofoil. The central panel is symmetrical on either side of a longitudinal axis 16. The front face of the central panel has a continuous convex surface 18, while the rear face of the central panel has two concave surfaces 20 meeting at a shallow central ridge 22. The width of each lateral panel is such that is can be folded inwardly, as indicated in FIGS. 2 and 3, to lie against the rear face of the central panel with the trailing edge of the lateral panel meeting the central ridge 22 and forming a smooth transition between the concave surface face of the folded-in lateral panel and the exposed concave surface face 20 of the central panel. The result is a composite aerofoil section made up from the three panels, as indicated in FIGS. 2 and 3.

To ensure that the two lateral panels move in concert, that is to say one moves in as the other moves out and no position arises in which both are simultaneously folded-in, the lateral panels are linked by a pair of straps 24, 26 which interconnect their rear and front faces respectively, the straps passing slidably through channels provided in the central panel. Thus, if the prevailing wind bears upon the extended lateral flap, tending to fold it inwardly, this force is transmitted through the strap 26, thereby causing the other lateral flap to open at the same time as the first flap is folded inwardly. The rear strap 24 prevents both lateral flaps from being simultaneously opened outwardly. This latter condition, however, can be useful when sailing before the wind, and accordingly the rear strap can be arranged so that its length can be increased the required amount when necessary, to allow both flaps to be opened, as shown in FIG. 5. Shortening of the rear strap once again will restore the flaps to their former condition, and the panels will assume one or other of the appropriate aerofoil shapes. This variation in the effective length of the rear strap 24 can be effected by a cam 17, as shown in FIGS. 4 and 5. The cam is rotatable about the axis 16 to bear upon the rear strap.

To incorporate the aerofoil in a sailing craft, the central panel is pivotally mounted about the axis 16 to the hull of the craft, with the axis vertical. Conveniently, the central panel can be rotatably carried on a longitudinally extending spindle which is then mounted at its lower end to the hull of the sailing craft in place of the conventional mast.

FIGS. 7 to 10 show the aerofoil mounted in this way. The craft is of the catamaran type, comprising twin hulls 40 rigidly interconnected by decking 42 and having depending stabiliser boards 44, twin rudders 46 and a self-steering vane 48 linked in conventional manner to the rudders. In place of the conventional mast, the central panel 10 of the aerofoil is pivotally mounted about the axis 16 at its lower end to the composite hull of the craft on its centre line. A rigid cruciform frame 50 is secured to the central panel immediately above the decking 42. The central panel 10 lies along two arms 52 of the frame and is secured thereto, thereby giving it lateral stabilisation, and stabilisation at right angles to this direction is provided by lines 54, 56 connecting the front and rear faces respectively of the central panel to the other two arms of the frame 58, 60 respectively. The arm 60 is longer than the other arms, and can conveniently provide a means by which the central panel can be rotated about its axis. Its free end can be slidably connected to an arcuate guide rail 61 (see FIGS. 8 to 10) to provide additional support and facilitate operation.

Figure 8:
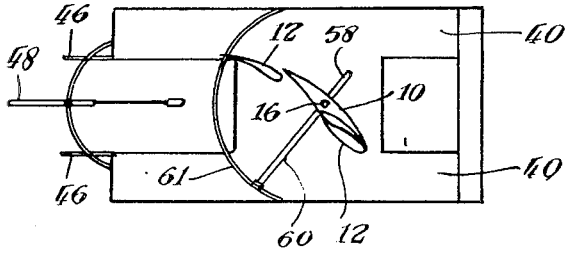
Figure 7:
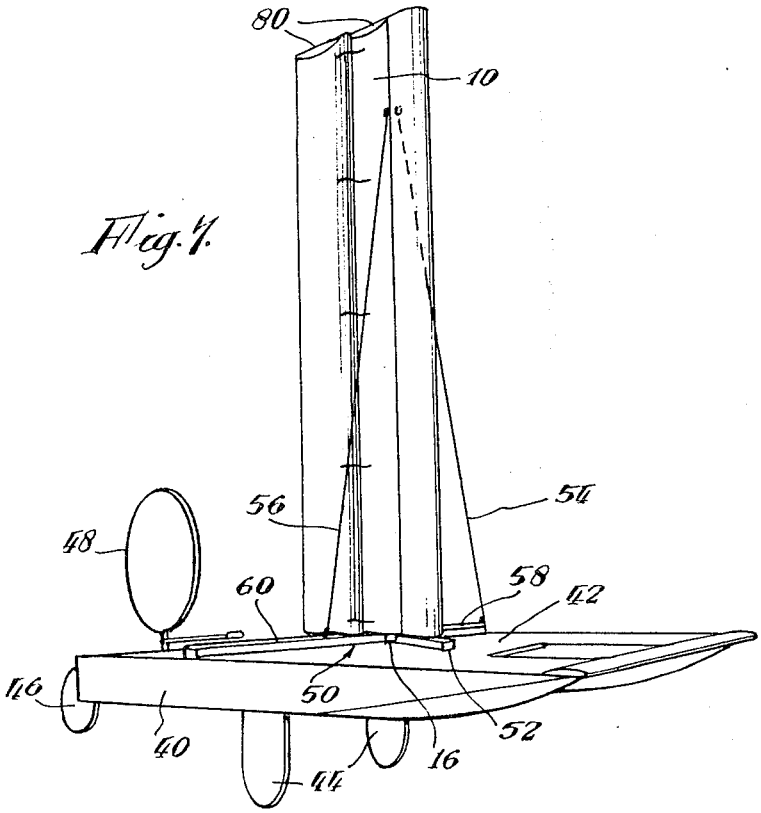

FIG. 7 shows a perspective view from the front starboard quarter, with the aerofoil in the configuration indicated in FIG. 2. FIG. 8 shows a plan view of the craft with the aerofoil in the configuration of FIGS. 2 and 7. FIG. 9 shows the aerofoil in the opposite configuration, as in FIG. 3. FIG. 10 shows the arm 60 in the fore-and-aft position and the aerofoil released into the fully open configuration of FIG. 5. In this form, the aerofoil acts as a spinnaker sail, and not strictly speaking as an aerofoil at all. It should be appreciated that in all the configurations shown, the angle of the central panel relative to the hull is determined by the person sailing the craft, or by such automatic control means as may be provided, just as the angle of the boom of a conventional sail is controlled during sailing. This angle is varied at will to suit the conditions, and the direction of the wind relative to the desired direction of the craft. The configuration of the lateral panels is, however, determined entirely by the flow of the air past the aerofoil. If the relative direction of the wind changes, it may act upon the open lateral panel and close it inwardly, thereby opening the other lateral panel and reversing the aerofoil shape. Since this is automatic, the sailor does not have to worry about the aerofoil configuration of the sail, unless he wishes to change to the spinnaker configuration.

FIG. 6 shows a development in which there is a pair of lateral flaps 30, 32 respectively, hinged at each side of a central panel 34. The smaller outer aerofoil-section lateral panel 32 is hinged at its leading edge to the trailing edge of the larger inner aerofoil-section lateral panel 30, which in turn is hinged at its leading edge to the edge of the central panel 34. Appropriate straps or other linkages are used to interconnect the panels so that they move between one composite aerofoil configuration, as shown in FIG. 6, and the other mirror-image configuration.

Referring now to FIGS. 11 to 14; this shows a development of the present invention, in which the aerofoil sail comprises a central panel 60 and two lateral panels 62 hinged thereto by means of hinge pins 64 on the lateral panels which pivotally engage in somewhat elongated recesses 66 in the central panel. This is most clearly seen in FIG. 13. Thus, the axes of pivotal connection between the central panel and the lateral panels are slightly adjustable, for the reason which will be explained below. The central panel 60 has a central mast 68 extending longitudinally through it, which provides a pivot axis for the central panel relative to the hull to which the aerofoil sail is to be mounted. The two lateral panels are interconnected by means of endless straps 70, each of which passes in a loop through the lateral panels and the central panel in the manner shown in FIG. 13. The rear face of the central panel is provided with a pair of somewhat elliptical surfaces 72 flanking a central trough surface 74. The surfaces 72 provide bearing surfaces around which similarly elliptical concave portions of the lateral panels can slide. Each lateral panel is in addition formed with a rib 76 which fits into the channel surface 74 of the central panel when that lateral panel is in the inwardly folded condition, as shown in FIGS. 12 and 13. In this condition, the trailing edge of the inwardly folded lateral panel meets the rear surface of the other lateral panel, and forms a smooth rear surface to the aerofoil. The straps 70 ensure that the two lateral panels hinge in concert relative to the central panel when moving between the two opposite aerofoil configurations shown in FIGS. 12, 13 and 14. FIG. 14 shows also the intermediate position of the lateral panels between the two opposite extreme positions. In the two extreme positions, the three panels are rigidly locked together. This comes about because the rear surfaces of the three panels are shaped so as to mate when in the extreme positions shown in FIGS. 12 and 13, and also because of the adjustability of the pivotal connections 64, 66. The recesses 66 are elongated in a direction which allows the somewhat elliptical adjacent surfaces of the central and lateral panels to slide past each other during pivoting, and in each of the extreme positions the somewhat elliptical surfaces of the extended lateral panel mates with that of the central panel and, together with the tightening of the strap, locks these two panels in the correct configuration. Thus, in the absence of any wind the three panels give the appearance of being somewhat loosely interconnected, whereas when the wind is acting on the panels and holding them in one of the aerofoil configurations, three panels are tightly held in a rigid composite aerofoil configuration against the constraint of the straps 70.

It will be seen that this type of aerofoil differs from that of the earlier embodiments in that a single aerofoil section is produced as against the double aerofoil section of the earlier embodiment. This provides a cleaner air flow and greater efficiency. The mounting of the aerofoil to the hull of the craft, and its mode of use, is generally similar to that already described for the earlier embodiment. As shown in FIG. 14; for a given position of the central panel 60, the shape of the aerofoil will change in accordance with the wind direction, as indicated by the three arrows. A spinnaker-type configuration can be arranged, if desired, using an extendable or releasable strap interconnection between the lateral panels.

An important feature of the aerofoil sails of the present invention is their high efficiency; that is a high lift to drag ratio. The best efficiency is normally obtained by an aspect ratio of greater than 2:1, but by putting a "fence" at the tops of the panels, as indicated at 80 in FIG. 7, thus reducing air spillage from the tip of the sail, a high efficiency can be obtained with an aspect ratio of less than 2:1, which obviously provides greater stability in the craft.

Various additional features may be incorporated in the sailing craft to assist in its control. For example, rather than use a long arm 60 as shown in FIGS. 7 to 10, for altering the position of the central panel, this arm could be shortened and a semi-circular steering bar provided to extend between the extremities of the two arms 52 and around the end of the arm 60. This steering bar could then be easily handled by a person sitting in the middle of the craft, rather in the manner of a vehicle steering wheel. As an alternative arrangement, particularly on single hull craft where it is desired to use a person's weight to help balance the craft, the arm 60 could be linked to a sliding seat which is movable along a track extending from side to side of the craft and even beyond the sides of the craft. Thus, the angle of the central panel will be adjusted by the person on the seat moving himself along the track, and his outwardly moving weight will help in counterbalancing the increasing sideways force of the wind on the sail as the central panel is swung from a transverse position towards a fore-and-aft position.

In a modified construction, the central panel can be joined to the lateral panels by flexible webs of material, thus forming an unbroken surface at the leading part of the section. The central panel may comprise a rigid framework over which a single flexible web joining the lateral panels is stretched when the lateral panels have assumed the foil section.

Although the panels are preferably substantially rigid, a small amount of resilient flexibility may be incorporated in at least the lateral panels. This can result in better mating of the panels, tighter securing by the straps or other tie means, and may also enable the overcamber or undercamber or both of the section to be increased by tightening the tie straps.

The foil can have a variable thickness to chord ratio if there are various alternative folded-in positions for the lateral flaps. FIG. 15 shows the panels can be mated in an alternative position to that shown in FIG. 13, and give a higher thickness to chord ratio. The panels are locked in this position by shortening the tie straps.

Although the invention has been particularly described in relation to aerofoils for sailing craft, the aerofoils can be similarly applied for example to land yachts, and for other applications. Also, the invention can be equally applied to produce reversible hydrofoils, for example in ship stabilisers or sluices.

FIG. 16 shows a modification of the aerofoil of FIGS. 1 to 5, in which the lateral panels 12 have slots 13 near their leading edge, which operate in known manner to transfer some of the air from the low pressure side to the high pressure side of the aerofoil and thereby help to maintain an attached airflow over the low pressure surface. This increases the lift and reduces the drag of the aerofoil. The drawing shows the extended lateral panel as having a variable angle with respect to the central panel 10. This is effected by shortening or lengthening the connecting straps, and does not alter the reversibility of the aerofoil, only its shape. The slot 13 becomes particularly important at high angles of deflection of the extended lateral panel 12. The gap between the extended lateral panel 12 and the central panel 10 also acts as a slot, both in this form and in the forms shown in FIGS. 1 to 6, so that the slot 13 provides an auxiliary effect. The edge portions 15 of the central panel 10 are made of resiliently flexible material which bears upon the leading edges of the lateral panels. This maintains an effective seal and smooth surface over the leading edge of the aerofoil. To provide the slot between the extended lateral panel 12 and the central panel, the leading edge of the lateral panels 12 are provided with cams 17 at intervals, which lift the adjacent resilient edge 15 when the lateral panel is extended, but allow the resilient edge to abut the lateral panel when in the folded-in condition.

I claim:

1. An aerofoil or hydrofoil, comprising:

a central panel having a central axis extending spanwise, said central panel being of symmetrical cross section of each side of said axis and having two opposite side edges;

at least two lateral panels each having first and second side edges;

means hinging each of said two lateral panels adjacent said first side edge thereof to said central panel at a respective one of said two opposite side edges of the central panel, to provide two alternative leading edges so that each lateral panel may pivot between an extended condition and a folded condition wherein the respective lateral panel is doubled back upon at least one of the central panel and the respective other lateral panel, to provide two alternative leading edges, the two lateral panels being of similar cross-section, and generally symmetrical with respect to said central axis, so that when said one lateral panel is extended and the other is folded an aerofoil or hydrofoil that is non-symmetrical in cross-section is formed, which is substantially a mirror image of the aerofoil or hydrofoil which may be formed by extending said other lateral panel and folding said one lateral panel, tie means interconnecting the lateral panels to move in concert, as follows: said one lateral panel folds as said other lateral panel extends and said other lateral panel folds as said lateral panel extends;

the effective leading edge of the aerofoil or hydrofoil incorporating said first side edge of whichever of the lateral panels as is in said folded condition.

2. An aerofoil or hydrofoil according to claim 1 wherein the tie means are adjustable so as to give more than two possible sections.

3. An aerofoil or hydrofoil according to claim 1, wherein the trailing edge of the inwardly folded lateral panel lies against the opposite lateral panel, the lateral panels providing thereby a substantially continuous undersurface to the section.

4. An aerofoil or hydrofoil according to claim 3, wherein the panels have mutually interfitting parts which mate when the panels are in the alternative configurations.

5. An aerofoil or hydrofoil according to claim 4 wherein hinge joints between the panels have a limited amount of play, and mutually interengaging parts on the panels are adapted to urge the hinge joints in a direction tending to oppose the constraint of the tie means as the panels move into one or other of the alternative configurations so that the panels are held rigidly together in said configuration.

6. An aerofoil or hydrofoil according to claim 1 wherein a gap occurs between the central panel and extended lateral panel which provides a slot allowing some transfer of fluid from the high pressure surface to the low pressure surface.

7. An aerofoil or hydrofoil according to claim 1, wherein the central panel is provided with resilient edge portions which bear upon the leading edge of the adjacent lateral panel when in the folded-in condition.

8. An aerofoil or hydrofoil according to claim 7, wherein cam elements are provided on the leading edge of the lateral panels adapted to lift the adjacent resilient edge of the central panel when the lateral panel is in its extended condition and thereby provide a slot allowing some transfer of fluid from the high pressure surface to the low pressure surface.

9. A sailing vehicle incorporating as an aerofoil sail an aerofoil according to claim 1, the central panel being pivotally mounted about its central longitudinal axis to the body of the vehicle, means being provided for controlling the angular position of the central panel about its axis relative to the body of the vehicle, the aerofoil being adjustable relative to the prevailing wind by rotation of the central panel about its pivot axis.

* * * * *